US009156155B2

(12) United States Patent
Poillot et al.

(10) Patent No.: US 9,156,155 B2
(45) Date of Patent: Oct. 13, 2015

(54) SUPPORT FOR A SERIES OF OFFSET SOCKET KEYS, AND CASE FOR OFFSET KEYS COMPRISING AT LEAST TWO CORRESPONDING HINGED SUPPORTS

(71) Applicant: STANLEY WORKS (EUROPE) GmbH, Duebendorf (CH)

(72) Inventors: Anthony Poillot, Besancon (FR); Christophe Panier, Besancon (FR); Pierre Tillier, Franois (FR)

(73) Assignee: Stanley Works (Europe) GmbH, Duebendorf (CH)

( * ) Notice: Subject to any disclaimer, the term of this patent is extended or adjusted under 35 U.S.C. 154(b) by 17 days.

(21) Appl. No.: 13/848,765

(22) Filed: Mar. 22, 2013

(65) Prior Publication Data

US 2013/0256168 A1 Oct. 3, 2013

(30) Foreign Application Priority Data

Mar. 30, 2012 (FR) ..... 12 00964

(51) Int. Cl.
*B65D 88/00* (2006.01)
*B25H 3/00* (2006.01)
*B25B 15/00* (2006.01)

(52) U.S. Cl.
CPC ..... *B25H 3/00* (2013.01); *B25B 15/008* (2013.01); *B25H 3/003* (2013.01)

(58) Field of Classification Search
USPC ..... 206/379, 376, 377, 372, 373, 315.6; 211/69, 70.6
See application file for complete search history.

(56) References Cited

U.S. PATENT DOCUMENTS

| | | | | | |
|---|---|---|---|---|---|
| D163,263 | S | * | 5/1951 | Dodd et al. | D6/469 |
| 2,810,472 | A | * | 10/1957 | Midkiff | 206/377 |
| 2,833,419 | A | * | 5/1958 | Trumpy | 211/70.6 |
| 3,997,053 | A | * | 12/1976 | Bondhus | 206/377 |
| 5,394,984 | A | * | 3/1995 | Aiba | 206/377 |
| 5,938,028 | A | * | 8/1999 | Hu | 206/377 |
| 6,053,316 | A | * | 4/2000 | Lo | 206/379 |
| 8,276,767 | B2 | * | 10/2012 | Su | 211/70.6 |
| 2007/0023306 | A1 | * | 2/2007 | Lai | 206/372 |
| 2008/0135447 | A1 | * | 6/2008 | Wang | 206/747 |

(Continued)

FOREIGN PATENT DOCUMENTS

| | | | |
|---|---|---|---|
| DE | 29609406 | U1 | 8/1996 |
| DE | 202004009153 | U1 | 9/2004 |

(Continued)

OTHER PUBLICATIONS

Search report dated Dec. 13, 2012 of the French Patent Office for priority application No. FR1200964.

*Primary Examiner* — Anthony Stashick
*Assistant Examiner* — James M Van Buskirk
(74) *Attorney, Agent, or Firm* — Richard J. Veltman; Adan Ayala

(57) ABSTRACT

The support for offset socket keys, each key comprising a first arm and a second arm which extend in a plane Q, comprises a body which is provided with a series of openings which extend in a plane P and a retention unit for retaining the series of keys relative to the body (4), the keys being offset vertically relative to each other. The retention unit is laterally offset relative to the plane P and is arranged sloping relative to the body in order to retain the vertically offset keys in the storage and transport position, in parallel planes Q which deviate angularly from the plane P.

12 Claims, 8 Drawing Sheets

(56) References Cited

U.S. PATENT DOCUMENTS

| | | | | |
|---|---|---|---|---|
| 2008/0202963 | A1* | 8/2008 | Liao | 206/377 |
| 2012/0012485 | A1* | 1/2012 | Wang | 206/377 |
| 2013/0228539 | A1* | 9/2013 | Lin | 211/70.6 |

FOREIGN PATENT DOCUMENTS

| | | | |
|---|---|---|---|
| DE | 202005012135 | U1 | 12/2005 |
| DE | 102006008225 | A1 | 8/2007 |

* cited by examiner

SUPPORT FOR A SERIES OF OFFSET SOCKET KEYS, AND CASE FOR OFFSET KEYS COMPRISING AT LEAST TWO CORRESPONDING HINGED SUPPORTS

This application claims the benefit of priority from French Patent Application No. 1200964, filed Mar. 30, 2012, the entire content of which is incorporated herein by reference.

The present invention relates to a support for a series of offset socket keys, whose dimensions increase from one key to the next, each key comprising a first arm and a second arm which extend in a key plane, the support being of the type comprising a member which extends in a general plane and which is provided with a series of openings which have increasing diameters and which are suitable for each receiving one of the first or second of the arms of a key and means for retaining the series of keys relative to the body which are suitable for each receiving the other of the first or second of the arms of a key, the keys being offset vertically relative to each other.

BACKGROUND OF THE INVENTION

Current cases which serve to store a series of offset socket keys having different sizes, generally from eight to ten in number, often present the keys in a flat state, all in the same plane or in parallel planes.

DE-U1-29682802 discloses a flat support which is provided with two faces, on each of which the offset keys are snap-fitted in the flat state in a vertically offset position relative to each other. Each arm of an offset key is retained by a constriction fastener. Though the retention of the large keys does not present any major difficulty, that of the small keys is not ensured, thereby increasing the risk of those keys becoming detached and lost.

FR-A1-2 680 724 discloses a case comprising at least two shells which are formed by separate pieces which are hinged together. The offset socket keys of one of the shells are arranged in openings and their heads are snap-fitted substantially perpendicularly relative to the plane of the shell, respectively. Access to any specific key is convenient but the arrangement of the series of keys makes the case provided with keys relatively bulky.

SUMMARY OF THE INVENTION

The object of the invention is to provide a support which has a smaller spatial requirement during its storage and transport whilst keeping the same convenience in use and retention of the keys.

To that end, the invention relates to a support of the above-mentioned type, characterised in that the retention means comprise a retention unit which is laterally offset relative to the general plane of the body and which is arranged sloping relative to the body in order to retain the vertically offset keys in the storage and transport position, in parallel planes which deviate angularly from the general plane of the body.

According to other features:

a connection portion having a curved cross-section connects the retention unit to the body;

the connection portion is integral with the upper face of the body and comprises a convex profile which is substantially complementary to the radii of internal curvature of the keys of the series;

the connection portion comprises a longitudinal shape which is progressive and a variable cross-section;

the unit comprises a series of constriction type notches, each notch being able to retain the other of the first or second of the arms of a key;

each notch comprises a C-shaped snap-fit means whose internal shape is complementary to the cross-section of each key;

the support is a rigid shell which is moulded in one piece from plastics material.

The invention also relates to a case for a series of offset socket keys whose dimensions increase from one key to the next, each key comprising a first arm and a second arm extending in a key plane, the case being of the type comprising two shells which are hinged together and which, in the storage and transport position, face each other, characterised in that at least one of the two shells, preferably both shells, is/are a support(s) as defined above.

According to other features:

the at least two shells face each other in the storage and transport position so that all their openings are substantially vertical with their axes contained in planes which are substantially parallel;

the at least two shells are hinged together by means of a removable metal shaft;

the at least two shells are formed by separate pieces, that is to say, a large shell which is suitable for receiving a series of large keys and a small shell which is suitable for receiving a series of small keys;

the substantially vertical edge of the small shell located next to the largest of the small keys is hinged to one of the substantially vertical edges of the large shell in such a way that the case can be folded and opened, in particular in the flat state, like a book;

the substantially vertical edge of the small shell located next to the largest of the small keys is hinged to the substantially vertical edge of the large shell located next to the largest of the large keys;

the case can be opened in a preferred stable position.

BRIEF DESCRIPTION OF THE DRAWINGS

Embodiments of the invention will now be described with reference to the accompanying drawings, in which.

DETAILED DESCRIPTION OF THE DRAWINGS

Figure 1:
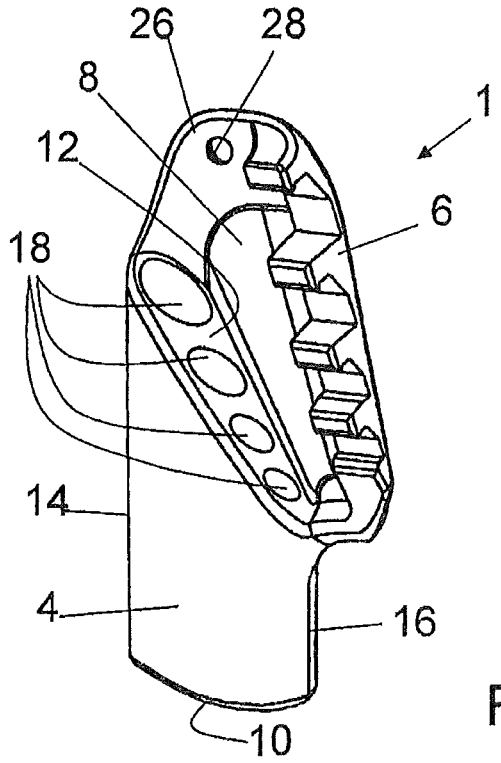
FIG. 1 is a perspective view of a support according to the invention.
Figure 2:
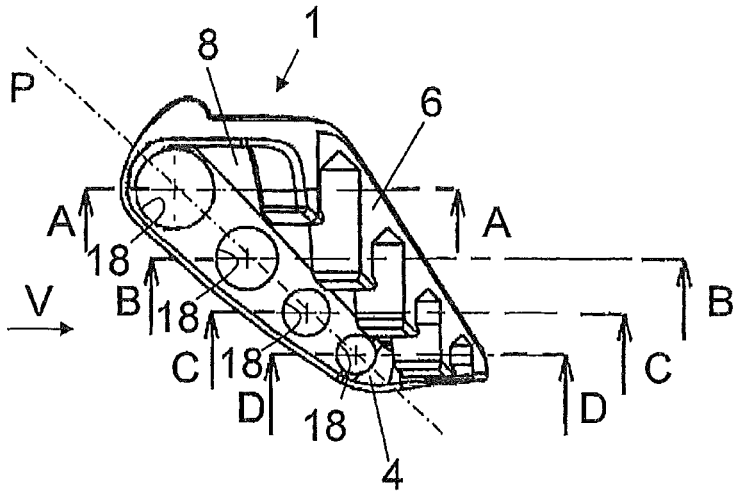
FIG. 2 is a plan view of the support of FIG. 1.
Figure 3A:
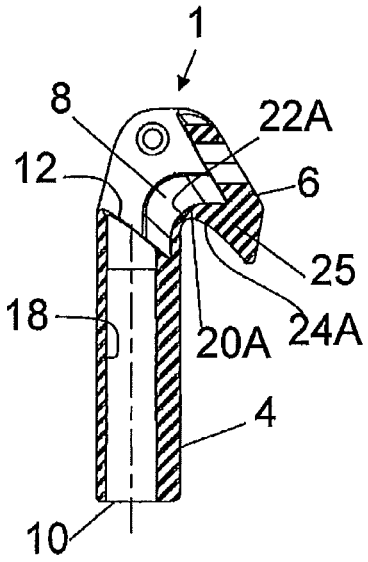
FIG. 3A is a sectional view of the same support along the arrows A-A of FIG. 2.
Figure 3B:
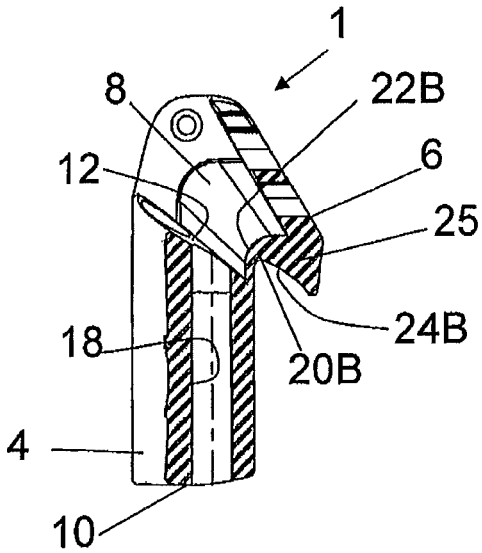
FIG. 3B is a sectional view of the same support along the arrows B-B of FIG. 2.
Figure 3C:
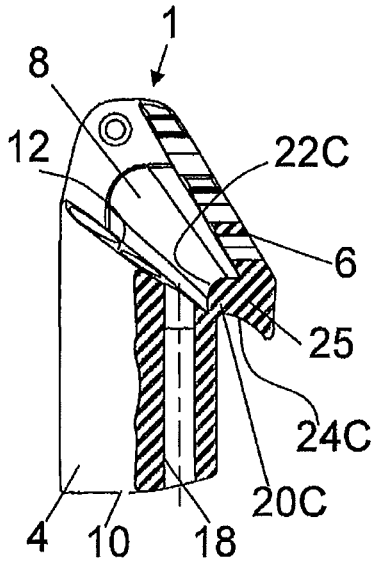
FIG. 3C is a sectional view of the same support along the arrows C-C of FIG. 2.
Figure 3D:
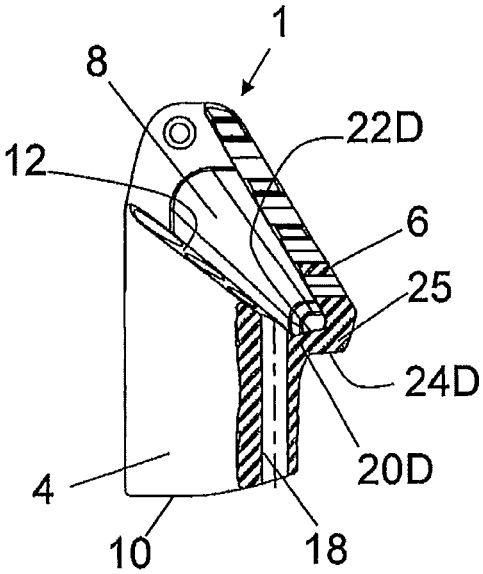
FIG. 3D is a sectional view of the same support along the arrows D-D of FIG. 2.
Figure 4:
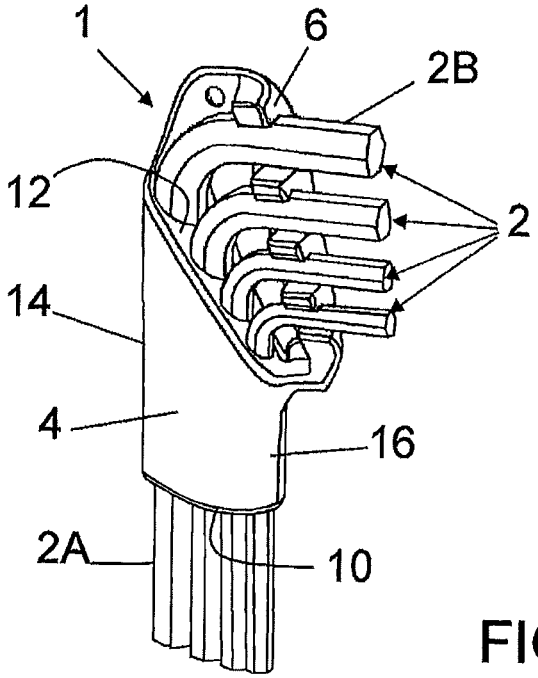
FIG. 4 is a perspective view of the support of FIG. 1 provided with a series of offset socket keys.

The terms "lower", "upper", "horizontal" and "vertical" used in the description below should be understood according to the orientation of the support of FIGS. 1 to 8 and the case of FIGS. 9 to 13.

The support 1 illustrated in FIGS. 1 to 8 is intended to receive a series of four offset socket keys 2 (FIG. 4) which have progressively increasing dimensions from one key to the next. Each key 2 comprises a first long arm 2A and a second short arm 2B and extends in a plane Q (FIG. 6) which contains those two arms. The support 1 comprises a body 4 and retention means 6 in the form of a retention unit, a connection portion 8 connecting the body 4 to the unit 6. The support 1 is a rigid shell, moulded in one piece from a plastics material.

The body 4 is of generally planar form which extends in a general plane P (FIG. 2) and, when viewed in elevation, a substantially trapezoidal form with a substantially horizontal lower face 10 and a sloping upper face 12 which descends from an almost vertical long edge 14 to an almost vertical short edge 16.

The unit 6 is laterally offset relative to the plane P and arranged sloping relative to the body 4. The unit 6 is intended to receive and retain the short arms 2B of the keys and allows the keys to be retained in a vertically offset state in the storage and transport position in parallel planes Q which deviate angularly from the general plane P of the body 4.

From the edge 14, the body 4 has four substantially vertical through-openings 18 which have decreasing diameters and which are intended to receive with friction the first long arm 2A of the four keys 2. The plane P contains the axes of the openings 18.

The connection portion 8 is integral with the upper face 12 of the body 4 and it has a progressively sloping longitudinal form, which is in particular substantially conical, and a variable cross-section 20A to 20D (FIGS. 3A to 3D). The cross-section is curved, at least in the main portion thereof, the face 22A to 22D being turned towards the openings 18 which comprise a convex profile which is substantially complementary to the radii of internal curvature of the keys of the series. The face 24A to 24D turned away from the openings 18 comprises a progressive concave profile which defines an overhanging protrusion 25 of the body 4 which acts as a base for the retention unit 6 of the keys of the series.

The connection portion 8 is extended in the upper portion by a substantially vertical wall 26 (FIG. 1), in which there is bored a horizontal hole 28 (FIG. 1) which is intended to receive a suspension spike or hook (not illustrated) for suspending the support 1.

Figure 5:
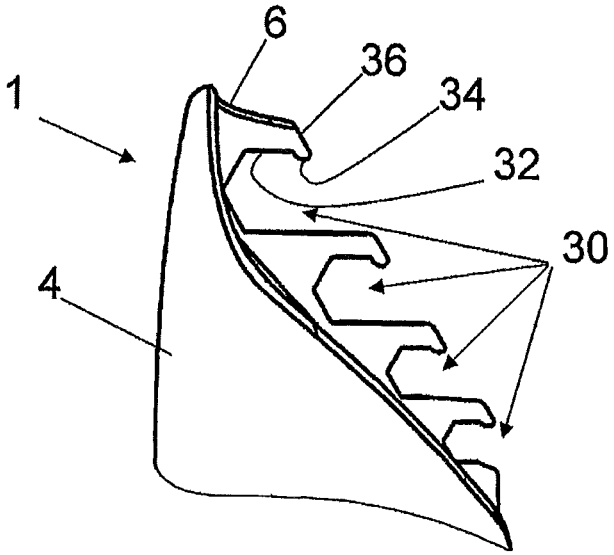
FIG. 5 is a partial front view along the arrow V of FIG. 2.

The retention unit 6 comprises a series of constriction type notches 30 (FIG. 5). Each notch is suitable for retaining the second short arm 2B of a key 2 and comprises a hook-shaped snap-fit means 32 whose internal C-shape is preferably partially complementary to the cross-section of the corresponding key. A constriction projection 34 is arranged at the free end 36 of the internal form of the hook 32 in order to partially close the opening in order to retain the corresponding key 2 in place by means of partial complementary of form.

Advantageously, the upper face 12 and the retention unit 6 slope in a substantially identical orientation. That allows a reduction in the dimensions of the connection portion 8 and facilitates the flow of the plastics material during the moulding from an injection point located on the body 4 towards the retention unit 6.

Figure 6:
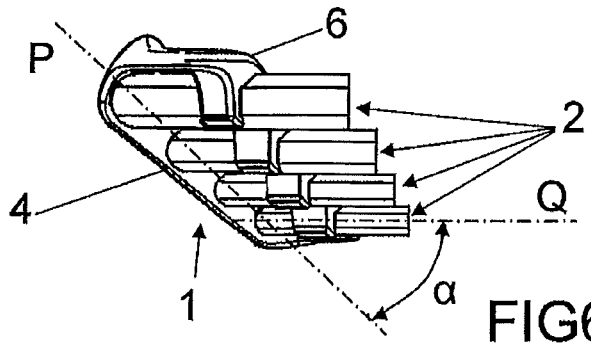
FIGS. 6, 7 and 8 are plan views showing a series of keys in the storage and transport position, respectively, a key of the same series in a position for removal from the support and all the keys of the same series in a position for removal from the support.

FIG. 6 illustrates a support 1 which is provided with a series of large keys 2, all arranged in the storage and transport position. In this configuration, the distance between the centres of the openings 18 of the long arms 2A of the keys 2 is adapted so that, when the short arms 2B of the keys 2 are snap-fitted in their C-shaped hook 32, respectively, the plane of each key is orientated relative to the general plane P of the body 4 at an angle $\alpha$ of approximately 45° and, in that configuration, the keys are offset relative to each other in order to prevent overlapping in the transverse dimension of the short arm of the keys, whilst remaining offset vertically.

Figure 7:
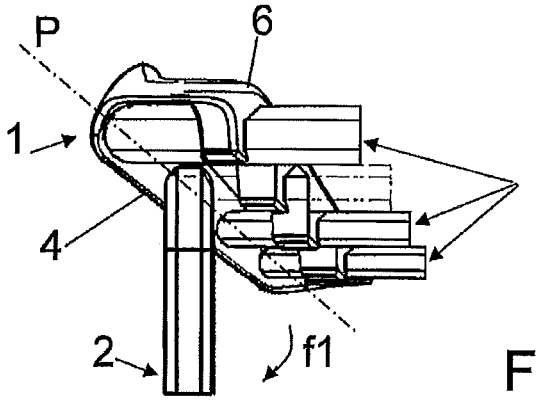

FIG. 7 illustrates the same support 1 which is provided with its series of keys 2. The larger of the two intermediate keys is arranged in a position ready for removal from the body 4. To that end, the operator acts on the key to be removed from the support 1 by turning it through an angle of 45° to 180° from its storage and transport position, in the clockwise direction along arrow f1. This action allows the separation of the short arm 2B from the corresponding snap-fit hook 32. In this removal position, the offset of the axes of the openings 18 which is intended to prevent overlapping in the storage and transport position is such that the removal of the key from the support does not require the movement of an adjacent key.

Figure 8:
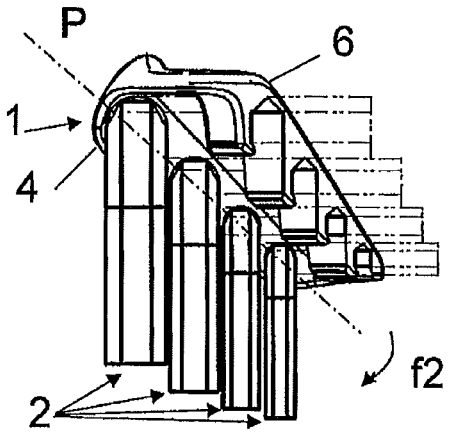
Figure 9:
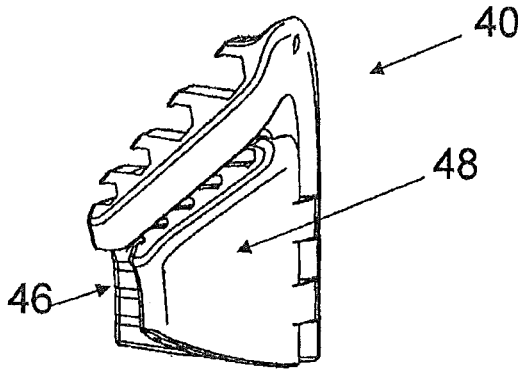
FIG. 9 is a perspective view of a case according to the invention in the storage and transport position.

FIG. 8 also illustrates the same support 1 which is provided with its series of keys 2. The operator acts on all the keys 2 by turning them through an angle of 90° from their storage and transport position in the clockwise direction along arrow f2. That action allows the short arms 2B to be separated from their respective hooks 32. All the keys are thereby arranged in a position ready for removal from the body 4. In the same manner as above, the offset of the axes of the openings 18 allows convenient removal of all the keys from the support, in particular simultaneous removal.

FIGS. 9 to 13 illustrate a case 40 which is intended to receive nine offset socket keys, that is to say, four large keys 42 and five small keys 44 (FIGS. 12 and 13), which have progressively increasing sizes. The case is formed by two shells moulded from a plastics material, that is to say, a large shell 46 which is provided to receive the four large keys 42 and a small shell 48 which is provided to receive the five small keys 44. The two shells are hinged together by means of a steel shaft 50. At least one and preferably both shells are configured in accordance with the structure and the functions of the support 1.

Figure 10:
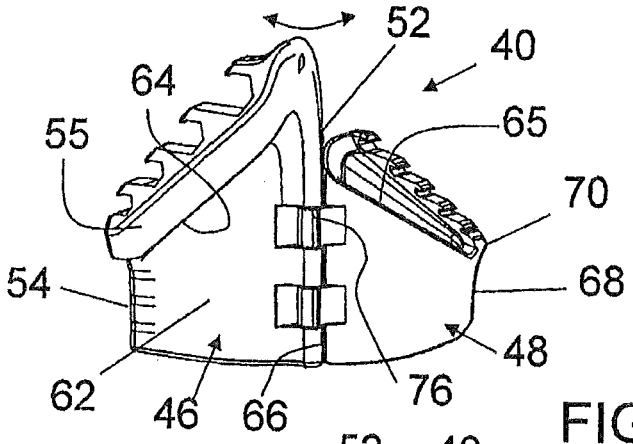
FIG. 10 is a perspective view of the same case in a position for use.
Figure 11:
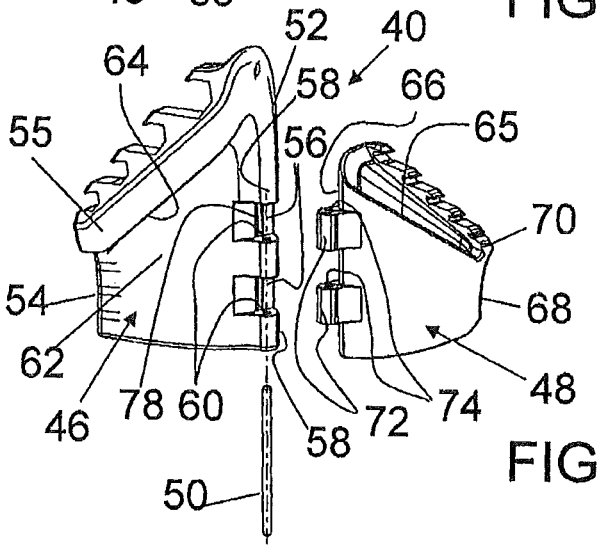
FIG. 11 is an exploded perspective view of the same case.

The shell 46 is of generally planar form and, when viewed in elevation, of generally trapezoidal form, with an upper face (not illustrated) descending from a substantially vertical long edge 52 to a substantially vertical short edge 54 (FIGS. 10 and 11).

In the region of the edge 52, however, the shell 46 deviates at one side away from the general plane P thereof (FIGS. 14 to 17).

From the edge 52, the shell 46 has four substantially vertical through-openings (not illustrated) which are identical to the openings 18 of the support 1 and whose axes are contained in the general plane P of the shell 46. The short arm of each large key is retained by snap-fitting in a retention unit 55 (FIGS. 10 to 13) in a manner identical to that of the unit 6 of the support 1. The edge 52 has two indentations 56 which define three hinge barrels 58, only two of which are indicated in FIG. 11 for the clarity of the drawing. Coaxial vertical holes 60 extend through the lower and central hinge barrels and the upper hinge barrel has, in the same alignment, a vertical blind hole which is open at the bottom. Furthermore, the lateral face 62 adjacent to the hinge barrels has an overhanging upper portion 64 which descends in accordance with the slope of the retention unit 55 of the shell 46.

The small shell 48 is also of generally planar form and, when viewed in elevation, is of generally trapezoidal form, with an upper face 65 which descends from a substantially vertical long edge 66 to a substantially vertical short edge 68 (FIGS. 10 and 11). From the edge 66, the shell 48 has five substantially vertical through-openings (not illustrated) which reduce in size and which are similar to the openings 18 of the support 1 but which have smaller diameters intended to receive with friction the long arm of the five smallest socket keys. The axes of the five openings are contained in the general plane P' (FIGS. 14 to 16) of the shell 48. The short arm of each small key is retained by snap-fitting in a retention unit 70 (FIGS. 10 to 13) in a manner identical to that of the unit 6 of the support 1.

The edge 66 deviates from the general plane P' (FIGS. 14 to 17) of the shell 48 in the same direction as the edge 52 of the shell 46. The edge 66 is cut away so as to form two hinge barrels 72 (FIG. 11) through which coaxial vertical holes 74 extend (FIG. 11) and which are suitable for being interposed between the hinge barrels 58 of the shell 46.

Advantageously, the substantially vertical edge 66 of the small shell 48 located next to the largest of the small keys 44 is hinged to one of the substantially vertical edges 52 and 54 of the large shell 46. Preferably, the substantially vertical edge 66 of the small shell 48 located next to the largest of the small keys 44 is hinged to the substantially vertical edge 52 of the large shell 46 located next to the largest of the large keys 42.

In order to assemble the case 40, as can be seen in FIG. 11, the two shells 46 and 48 are positioned substantially in alignment with each other, they are moved together in order to insert the hinge barrels 58 and 72 and the shaft 50 is introduced through the holes 60 and 74 and, with force, into the blind hole of the upper hinge barrel 58.

Figure 12:
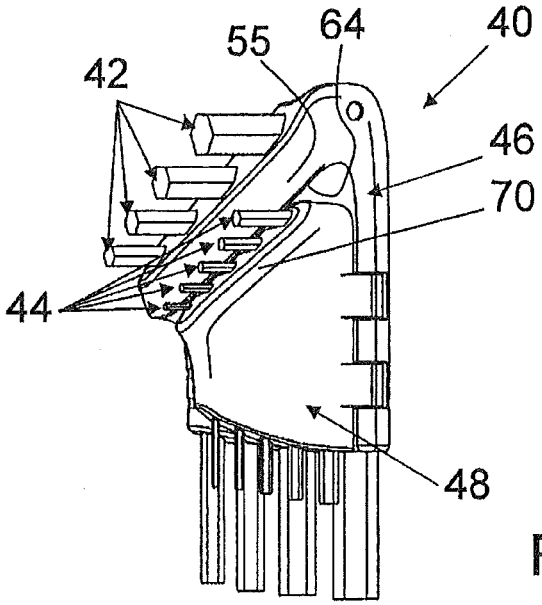
FIGS. 12 and 13 are front views of the case provided with keys in the storage and transport position and in a position for use, respectively.
Figure 13:
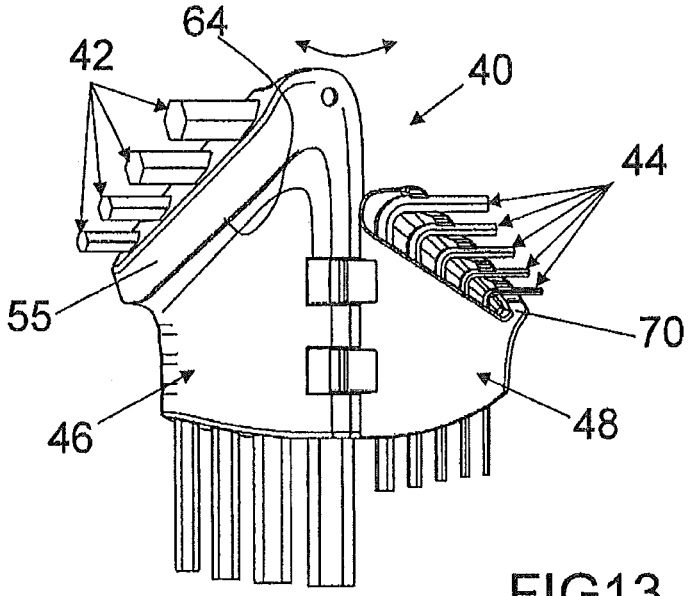
Figure 14:
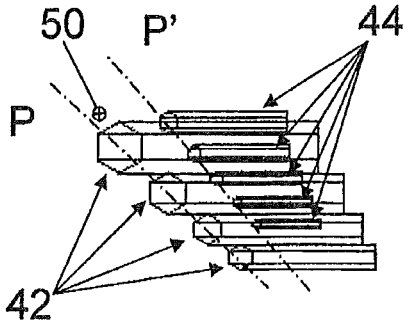
FIGS. 14 and 15 are schematic plan views in which the case has been hidden for the clarity of the drawings and in which two variants for positioning a series of offset keys are illustrated in the storage and transport position.
Figure 15:
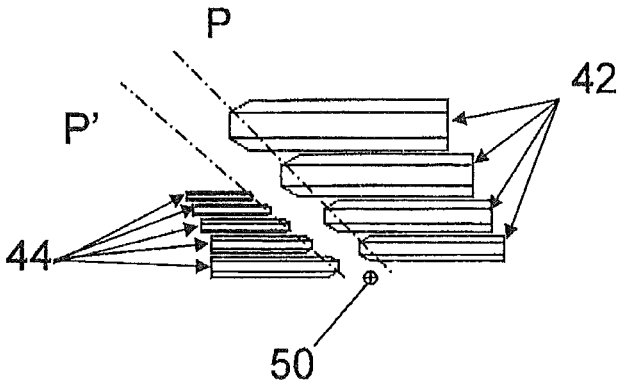
Figure 16:
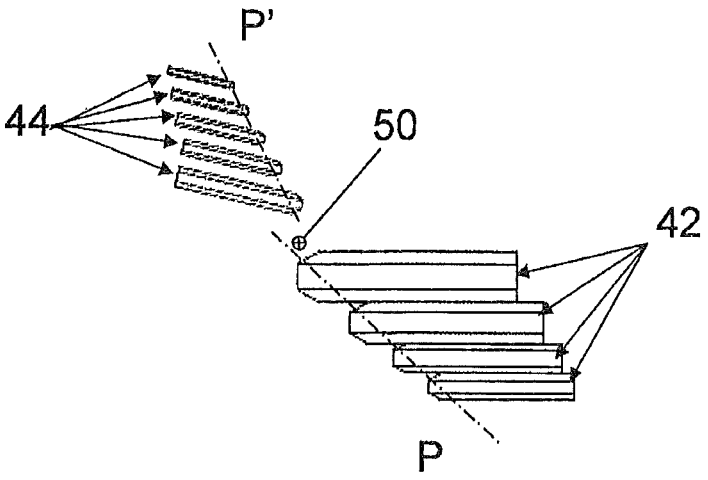
FIGS. 16 and 17 are schematic plan views similar to FIGS. 14 and 15, illustrating the two variants for positioning a series of offset keys in the deployed position for use.
Figure 17:
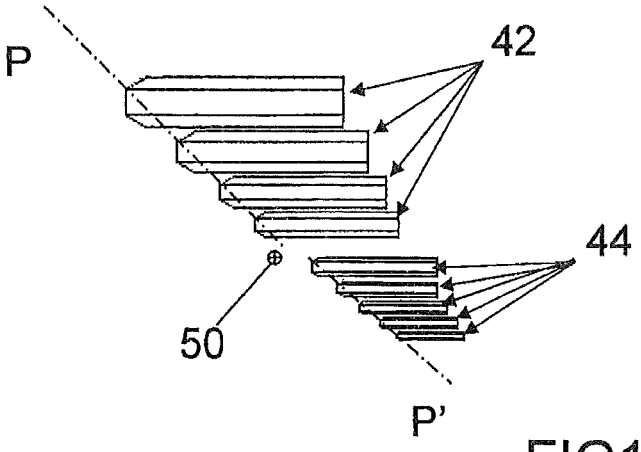

The shells can then be opened and closed like a book in order to take up two main positions:

the storage and transport position which is folded (FIGS. 9, 12, 14 and 16) and in which the case 40 is folded about the shaft 50 and the shell 48 is pressed against the shell 46. In that position, the keys of each of the two series are offset vertically and positioned in substantially parallel planes Q in the same orientation as the small arms (FIGS. 12 and 14). In a variant illustrated in FIG. 15, the arrangement of the keys in the case is such that each of the shells comprises retention means for its series of keys and, in the storage and transport position, the two series of keys are vertically offset and positioned in substantially parallel planes Q in opposite orientations of the small arms. However, the general planes P and P' (FIGS. 14 and 15) which contain the axes of the openings of the large shell 46 and those of the small shell 48 are substantially parallel and close to each other;

a position for use which is deployed (FIGS. 10, 13, 16 and 17) and in which the plane P' (FIGS. 16 and 17) of the shell 48 is substantially arranged at an angle of approximately 150° to 180° in the plane P of the shell 46 (FIGS. 16 and 17). In that position, the keys of each of the two series are vertically offset and positioned in planes Q which are substantially parallel in the same orientation as the small arms (FIG. 17) or in opposite orientations (FIGS. 13 and 16). The general planes P and P' (FIGS. 16 and 17) which contain the axes of the openings of the large shell 46 and those of the small shell 48 are substantially flat with respect to each other, like an open book.

In the storage and transport position (FIG. 12), the shell 48 is folded against the shell 46 and the long arms of the small keys 44 are pressed against the shell 46. The small keys fit into the space occupied by the large keys, the spatial requirement of the assembly thereby being considerably reduced (FIG. 14).

In the deployed position (FIG. 13), when the short arms are retained in the snap-fit hooks, the keys of each shell are offset progressively, in the vertical direction, relative to each other, so as to fit between each other and, consequently, to occupy a space close to the minimum space.

Of course, if the user needs only one of the large keys, it is not necessary to open out the case. The expression "position for use of the case" is therefore used only for convenience.

Furthermore, as illustrated in FIG. 12, the overhanging zone 64 of the unit 55 of the shell 46 is positioned just above the short arms of the small keys 44 locking them in position, in a folded position of the case 40, and thereby preventing them from being removed in that position.

Furthermore, the case can also take any stable, partially open position. Accordingly as illustrated in FIG. 10, protrusions 76 which are provided on at least one hinge barrel 72 may, by cooperation with a recess 78 combined with an indentation 56, define at least one preferential stable opening position of the casing 40.

The construction of the case according to the invention from at least two shells formed by separate pieces allows the production of the shells in different materials and/or colours.

According to the invention, the support or the case is convenient to use, whilst retaining a reduced spatial requirement.

The invention applies to the storage of offset socket keys having a hexagonal or circular cross-section.

The invention claimed is:

1. A support for a series of offset socket keys whose dimensions increase from one key to the next, each key comprising a first arm and a second arm which extend in a key plane, the support comprising:

a body which extends in a general plane and which is provided with a series of openings which have increasing diameters and which are suitable for each receiving one of the first arm and second arm of a key:

means for retaining the series of keys relative to the body which are suitable for each receiving the other of the first arm and second arm of a key, the keys being offset vertically relative to each other; and a connection portion having a curved cross-section, the connection portion connecting the means for retaining to the body, wherein the means for retaining comprises a retention unit which is laterally offset relative to the general plane of the body and which is arranged sloping relative to the body in order to retain the vertically offset keys in the storage and transport position, in parallel planes which deviate angularly from the general plane of the body.

2. A support according to claim 1, wherein the body further includes an upper face and the connection portion is integral with the upper face and comprises a convex face which is substantially complementary to a radii of internal curvature of the keys.

3. A support according to claim 1 wherein the connection portion (8) comprises a longitudinal shape which is progressive and includes a variable cross-section.

4. A support according to claim 2 wherein the connection portion (8) comprises a longitudinal shape which is progressive and includes a variable cross-section.

5. A support according to claim 1 wherein the retention unit comprises a series of constriction type notches, each notch being able to retain the other of the first arm and second arm of a key.

6. A support according to claim 5, wherein each notch comprises a C-shaped snap-fit means whose internal shape is complementary to the cross-section of each key.

7. A support according to claim 1, wherein the support is moulded in one piece from a plastics material in the form of a rigid shell.

8. A case for a series of offset socket keys whose dimensions increase from one key to the next, each key comprising a first arm and a second arm extending in a key plane, the case comprising:

a body having at least two shells which are hinged together and which, in a storage and transport position, face each other and means for retaining the series of keys relative to the body which are suitable for each receiving one of the first arm and second arm of a key, the keys being offset vertically relative to each other, wherein each shell extends in a general plane and is provided with a series of openings which have increasing diameters and which are suitable for each receiving the other of the first arm and second arm of a key; and wherein the means for retaining further includes a retention unit which is laterally offset relative to the general plane of the body and which is arranged sloping relative to the body in order to retain the vertically offset keys in the storage and transport position, in parallel planes which deviate angularly from the general plane of the body; and wherein a substantially vertical edge of the second shell is located next to the largest of the second set of keys and is hinged to a substantially vertical edge of the first shell in such a way that the case can be folded and opened in a substantially flat state; and wherein the substantially vertical edge of the second shell is hinged to the substantially vertical edge of the first shell, the vertical edge of the first shell being located next to the largest of the first set of keys.

9. A case according to claim 8, characterised in that the at least two shells face each other in a storage and transport position so that all their openings are substantially vertical with their axes contained in planes that are substantially parallel.

10. A case according to claim 8, wherein the at least two shells are hinged together by a removable metal shaft.

11. A case according to any one of claim 8, wherein the case can be opened in a preferred stable position.

12. A case according to claim 8, wherein the at least two shells include a first shell and a second shell, the first shell being sized to receive a first set of keys and the second shell being sized to receive a second set of keys, the keys of the first set of keys being larger than the keys of the second set of keys.

* * * * *